US007730997B2

(12) United States Patent
Asada et al.

(10) Patent No.: US 7,730,997 B2
(45) Date of Patent: Jun. 8, 2010

(54) AIR INTAKE NOISE REDUCING DEVICE, INTERNAL COMBUSTION ENGINE FITTED WITH THE SAME AND STRUCTURE FOR FITTING THE SAME TO THE INTERNAL COMBUSTION ENGINE

(75) Inventors: Sadao Asada, Utsunomiya (JP); Takuya Funatsu, Utsunomiya (JP); Kenji Yamashita, Utsunomiya (JP)

(73) Assignee: Kokoku Intech Co., Ltd., Tokyo (JP)

( * ) Notice: Subject to any disclaimer, the term of this patent is extended or adjusted under 35 U.S.C. 154(b) by 0 days.

(21) Appl. No.: 12/225,229

(22) PCT Filed: Mar. 13, 2007

(86) PCT No.: PCT/JP2007/054944

§ 371 (c)(1),
(2), (4) Date: Sep. 16, 2008

(87) PCT Pub. No.: WO2007/105722

PCT Pub. Date: Sep. 20, 2007

(65) Prior Publication Data

US 2009/0038880 A1 Feb. 12, 2009

(30) Foreign Application Priority Data

Mar. 16, 2006 (JP) ..... 2006-072447

(51) Int. Cl.

| | |
|---|---|
| ***F01N 1/08*** | (2006.01) |
| ***F02M 35/12*** | (2006.01) |
| *F01N 1/00* | (2006.01) |
| *F02M 35/10* | (2006.01) |
| *F02M 29/04* | (2006.01) |

(52) U.S. Cl. ..... 181/270; 181/281; 181/258; 123/184.53; 123/593; 138/41

(58) Field of Classification Search ..... 181/229, 181/270, 281, 258, 233; 123/184.53, 184.54, 123/593; 48/189.6; 392/386; 138/39, 41
See application file for complete search history.

(56) References Cited

U.S. PATENT DOCUMENTS 1,340,062 A * 5/1920 Lapham ..... 123/593

(Continued)

FOREIGN PATENT DOCUMENTS

JP 55091756 A * 7/1980

(Continued)

*Primary Examiner*—Edgardo San Martin
(74) *Attorney, Agent, or Firm*—James Creighton Wray; Meera P. Narasimhan

(57) ABSTRACT

The present invention provides an air intake noise reducing device, an internal combustion engine fitted with the air intake noise reducing device and a structure for fitting the air intake noise reducing device to the internal combustion engine. The air intake noise reducing device comprises a gasket (2) comprising a ring member (2*a*) held by connecting surfaces of an air intake passage (100) and protrusion holding portions (2*b*) extending from the ring member (2*a*) toward a center of the air intake passage (100); and a net member (3) comprising a net (3*a*) for rectifying intake air and connecting protrusions (3*b*) extending outward from the net (3). The connecting protrusions (3*b*) are held in the protruding holding portions (2*b*) such that the ring member (3) is firmly secured to the gasket (3). The air intake noise reducing device constituted by in the above-mentioned manner can reduce assembly man-hours without deteriorating a sealing property of the air passage.

7 Claims, 5 Drawing Sheets

U.S. PATENT DOCUMENTS

| | | | | | |
|---|---|---|---|---|---|
| 1,585,403 | A | * | 5/1926 | Mayer et al. | 48/189.6 |
| 1,620,410 | A | * | 3/1927 | Tansill | 48/189.6 |
| 1,629,964 | A | * | 5/1927 | Price | 48/189.6 |
| 3,572,391 | A | * | 3/1971 | Hirsch | 138/40 |
| 3,934,569 | A | * | 1/1976 | Bobene | 123/593 |
| 4,088,103 | A | * | 5/1978 | Brown | 123/593 |
| 4,094,290 | A | * | 6/1978 | Dismuke | 48/189.6 |
| 4,295,458 | A | * | 10/1981 | Pellerin | 48/189.4 |
| 4,359,035 | A | * | 11/1982 | Johnson | 123/593 |
| 4,672,940 | A | * | 6/1987 | Nakayama et al. | 123/590 |
| 4,691,894 | A | * | 9/1987 | Pyotsia et al. | 251/127 |
| 4,756,294 | A | * | 7/1988 | Nakayama et al. | 123/549 |
| 5,388,559 | A | * | 2/1995 | O'Keefe | 123/593 |
| 5,429,102 | A | * | 7/1995 | Edwards et al. | 123/593 |
| 5,482,249 | A | * | 1/1996 | Schafbuch et al. | 251/118 |
| 5,722,357 | A | * | 3/1998 | Choi | 123/184.21 |
| 5,758,614 | A | * | 6/1998 | Choi | 123/184.53 |
| 5,970,963 | A | * | 10/1999 | Nakase et al. | 123/590 |
| 6,145,544 | A | * | 11/2000 | Dutertre et al. | 138/39 |
| 6,880,579 | B2 | * | 4/2005 | Boger | 138/44 |
| 7,086,498 | B2 | * | 8/2006 | Choi et al. | 181/270 |
| 7,089,963 | B2 | * | 8/2006 | Meheen | 138/44 |
| 7,146,961 | B1 | * | 12/2006 | Westcott | 123/184.53 |
| RE40,621 | E | * | 1/2009 | Choi | 123/590 |
| 2008/0156385 | A1 | * | 7/2008 | Treimer et al. | 138/37 |

FOREIGN PATENT DOCUMENTS

| | | |
|---|---|---|
| JP | 60-88861 | 5/1985 |
| JP | 62-21980 | 5/1987 |
| JP | 9-303223 | 11/1997 |
| JP | 11-141416 | 5/1999 |
| JP | 2002-531767 | 9/2002 |
| JP | 2002-295322 | 10/2002 |

* cited by examiner

AIR INTAKE NOISE REDUCING DEVICE, INTERNAL COMBUSTION ENGINE FITTED WITH THE SAME AND STRUCTURE FOR FITTING THE SAME TO THE INTERNAL COMBUSTION ENGINE

This application claims the benefit of Japanese Application No. 2006-072447 filed Mar. 16, 2006 and PCT/JP2007/054944 filed Mar. 13, 2007, which are hereby incorporated by reference in their entirety.

FIELD OF THE INVENTION

The present invention relates to an air intake noise reduction device, an internal combustion engine fitted with the air intake noise reduction device and a structure for fitting the air intake noise reducing device to the internal combustion engine.

RELATED BACKGROUND ART

Conventionally, the amount of intake air to an internal combustion engine such as an automobile engine is adjusted by opening or closing throttle valves arranged in air intake passages. When the throttle valves are opened rapidly, large amount of air is sucked in a short period, so that unusual sounds or noises are caused in surge tanks, intake manifolds and the like connected to or arranged at downstream of the throttle valves.

In order to suppress such unusual sounds, a structure comprising a net arranged at downstream of the throttle valve is proposed (for example, see reference 1).

Hereinafter, one of the conventional devices for reducing noises caused during the air intake operation is explained as referring to drawings.

FIG. 6 is a schematic view of an air intake passage of an internal combustion engine. FIG. 7 is a schematic perspective view of an air intake noise reducing device. FIG. 8 (*a*) shows a cross-sectional view along C-C line in FIG. 7 and FIG. 8 (*b*) shows a cross-sectional view along D-D line in FIG. 7.

An air intake noise reducing device 101 is arranged at a downstream position from a throttle valve 110 in the vicinity where the device can affect air streams from the throttle valve 110. The air intake noise reducing device 101 is arranged at a connecting portion of an air intake passage 100, where two pipe members, for example a throttle body and a surge tank are abutted each other, so that the air intake noise reducing device is held by both ends of the pipe members.

A reference numeral 102 is an annular gasket. Airtightness at the connecting portion is secured by the annular gasket 102, which is held by end surfaces of the throttle body and the surge tank.

A reference numeral 103 is a net for reducing the air intake noise. Air flowing through the air intake passage 100 is dispersed and rectified by the net 103, so that the air intake noise is reduced. A metal mesh and the like are employed as the net 103.

As shown in FIG. 7 and FIG. 8 (*a*), the gasket 102 and the net 103 are connected each other by inserting protruded portions 104 formed around the periphery of the net 103 into the gasket 102. Further, as shown in FIG. 8 (*b*), sometimes an outer rim 105 for connecting protruded portions 104 together, passes through the gasket 102.

The net 103 and the gasket 102 are formed into a one-pieced device such that the protruded portions 104 and the outer rim 105 are fixed to the gasket 102 by an adhesive.

Reference 1: Japanese laid open patent No. 11-141416

DISCLOSURE OF THE INVENTION

Problems to be Solved by the Invention

As mentioned above, the conventional air intake noise reducing device is formed into the one-pieced device by inserting portions of the net 103 into the gasket 102 and further being fixed by the adhesive.

In the one-pieced device, surface pressure of the gasket 102 differs from portions of the gasket 102 whether the protruded portions 104 and the outer rim are contained or not. As a result, there arises a problem that sealing effects of the gasket 102 are deteriorated.

Further, in order to fix the net 103 to the gasket 102, an adhering treatment process is required in the conventional air intake reducing device.

The present invention is carried out in view of the above-mentioned problems in order to provide the air intake noise reducing device with less assembling man-hours as maintaining a sealing property, and to provide the internal combustion engine fitted with such device and the structure for fitting such device to the internal combustion engine.

Means to Solve the Problem

In order to solve the problems mentioned above, the present invention is constituted as follows.

(1) An air intake noise reducing device comprises: a seal member comprising a ring member held by connecting surfaces of an air intake passage and protrusion holding portions extending from the ring member toward a center of the air intake passage; and an air intake noise reducing member comprising a net for rectifying intake air and connecting protrusions extending outward from the net, wherein: the connecting protrusions are held in the protruding holding portions such that the air intake noise reducing member is firmly secured to the seal member.

(2) The air intake noise reducing device according to (1), wherein: the connecting protrusion is held within the protrusion holding portion such that a tip end of the connecting protrusion does not protrude into the ring member.

(3) The air intake noise reducing device according to (1) or (2), wherein: the connecting protrusion has a fitting portion for being fitted to the protrusion holding portion.

(4) The air intake noise reducing device according to (3), wherein: the fitting portion is formed in a small holed shape and/or in a wedge shape.

(5) The air intake noise reducing device according to one of (1) to (4), wherein: the protrusion holding portion has positioning members for positioning the air intake noise reducing device to the air intake passage.

(6) An internal combustion engine comprises: the air intake noise reducing devices according one of the constitutions (1) to (5); and an air intake passage comprising a seal holding groove for holding the ring member of the air intake noise reducing device and protrusion holding recesses for holding the protrusion holding portions.

(7) A fitting structure formed in an air intake passage of an internal combustion engine, wherein: the air intake noise reducing devices according to one of the constitutions (1) to (5) is arranged downstream and in the vicinity of a throttle valve in the air intake passage; protrusion holding recesses are formed on connecting surfaces of the air intake passage; and the air intake noise reducing device is fitted to the air intake passage such that protrusion holding portions of the air intake noise reducing device are held by the protrusion holding recesses.

Effects Attained by the Invention

The present invention can provide the air intake noise reducing device with less assembling man-hours as maintaining the sealing property. The present invention can also provide internal combustion engines fitted with such devices and the structure for fitting such device to the internal combustion engine, so that air intake noises generated in the internal combustion engines are reduced.

PREFERRED EMBODIMENTS BY THE PRESENT INVENTION

Hereinafter, the preferred embodiments by the present invention are explained as referring to drawings.

A scope of the present invention is not limited to dimensions, materials, shapes and arrangements of components and the like mentioned in the patent specification, unless specifically described in the present patent specification.

Embodiment 1

Figure 1:
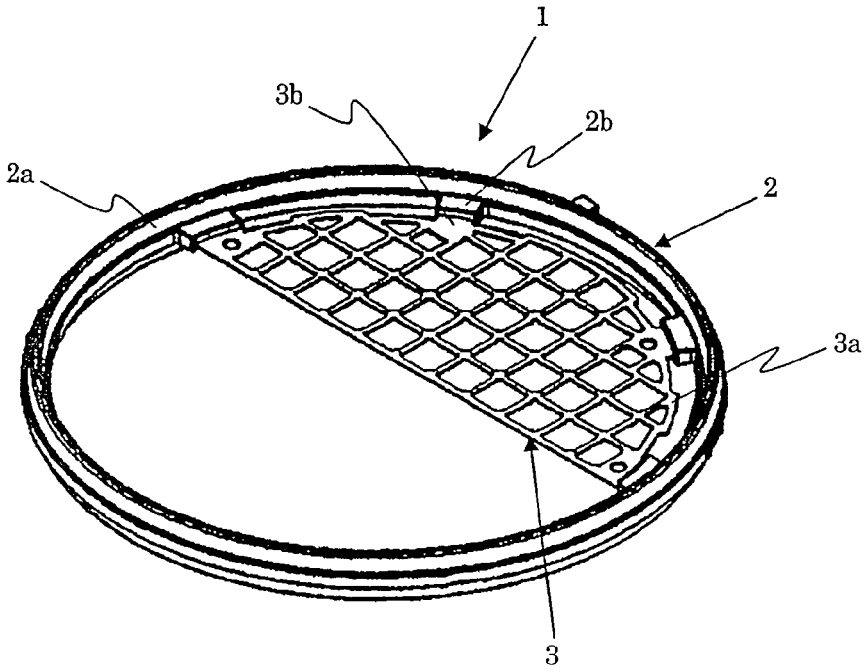
FIG. 1 is a perspective schematic view illustrating a whole structure of embodiment 1.

FIG. 1 is the perspective schematic view illustrating the whole structure of embodiment 1. An air intake noise reducing device 1 has a gasket 2 functioning as a seal member and a net member 3 functioning as an air intake noise reducing member arranged inside the gasket 2. In the present embodiment, the gasket 2 is made of the same rubber as that employed by the conventional air intake noise reducing device, and the net member 3 is made of the same metal as that also employed by the conventional air intake noise reducing device. But materials for the gasket or the net member are not limited to the same rubber or the same metal as the conventional device.

Figure 6:
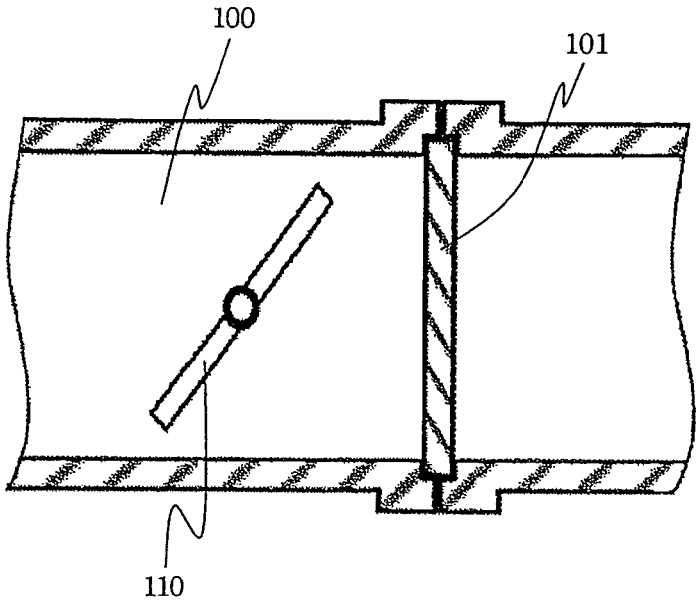
FIG. 6 is a schematic view illustrating an air intake passage of an internal combustion engine.
Figure 7:
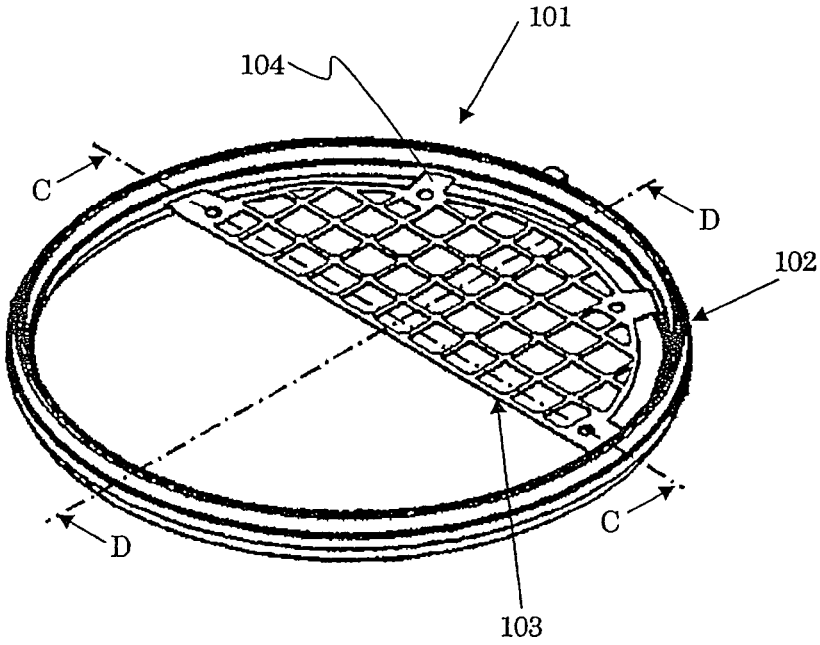
FIG. 7 (PRIOR ART)
FIG. 7 is a perspective schematic view illustrating the structure of the conventional air intake noise reducing device.
Figure 8:
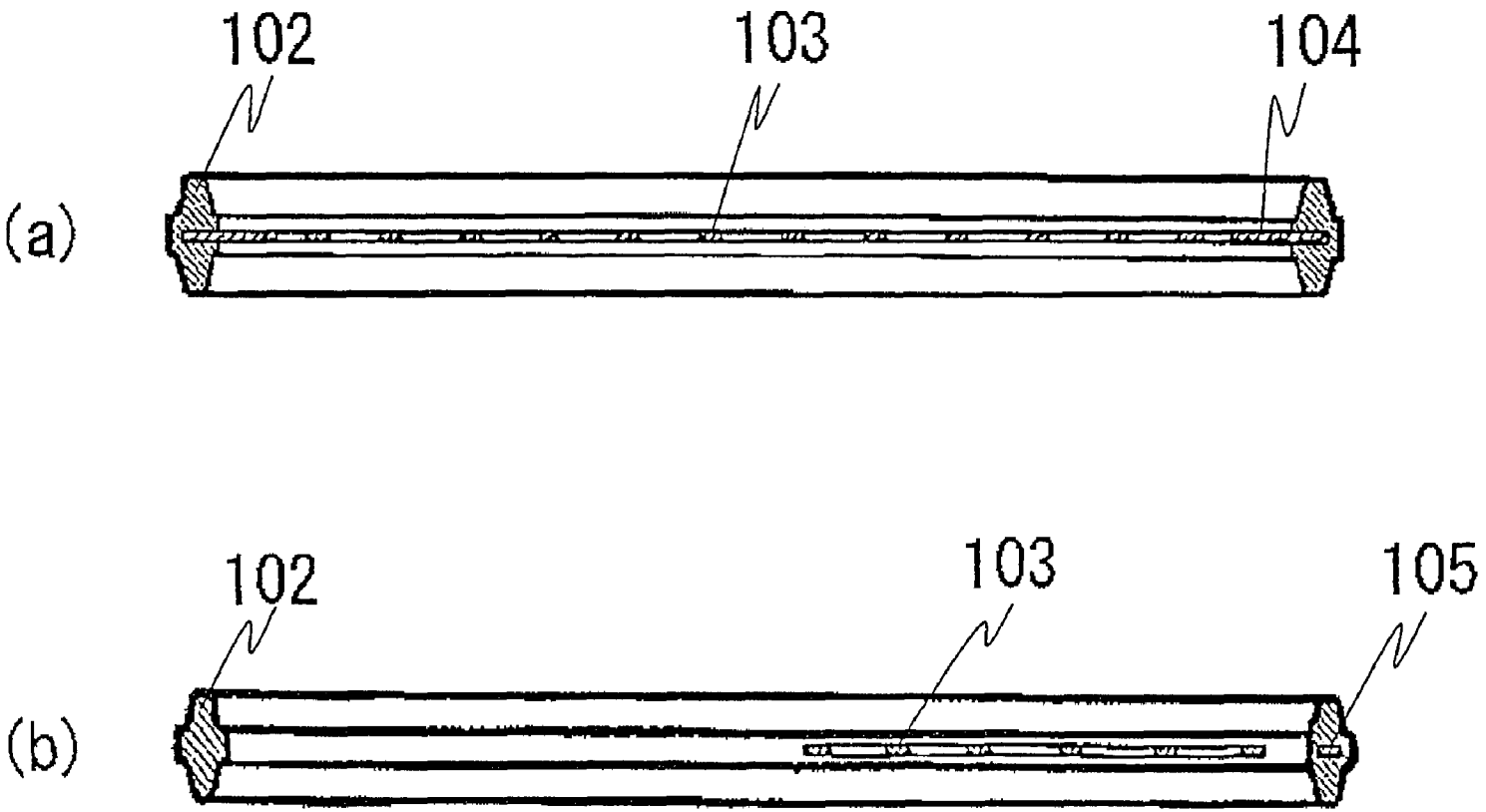
FIG. 8 (PRIOR ART)
FIG. 8 is cross-sectional views of the conventional device illustrated in FIG. 7. (*a*) is the cross-sectional view along C-C line in FIG. 7 and (*b*) is the cross-sectional views along D-D line in FIG. 7.

The gasket 2 has a ring member 2*a* which is held by the both ends of the pipe members of the air intake passage 100 as illustrated in FIG. 6. Protrusion holding portions 2*b* are formed on an inside surface of the ring member 2*a* as extending toward the center of the gasket 2.

The net member 3 has a net 3*a* which covers a predetermined area of the cross section of the air intake passage 100. Intake air flowing through the air intake passage 100 is rectified as passing through the net 3*a*, so that the noise caused during the air intake is reduced. Connecting protrusions 3*b* are formed around the periphery of the net 3*a* extending outward from the net member 3.

The number and arrangement of the connecting protrusions 3*b* is determined in accordance with those of the protrusion holding portions 2*b*. In the present embodiment, the numbers of the connecting protrusions 3*b* and the protrusion holding portions are set at four. As explained in detail afterward, the connecting protrusions 3*b* are held in the protrusion holding portions 2*b* of the gasket 2, so that the net member 3 is secured to the gasket 2 and as a result a one-pieced device is constituted.

Figure 2:
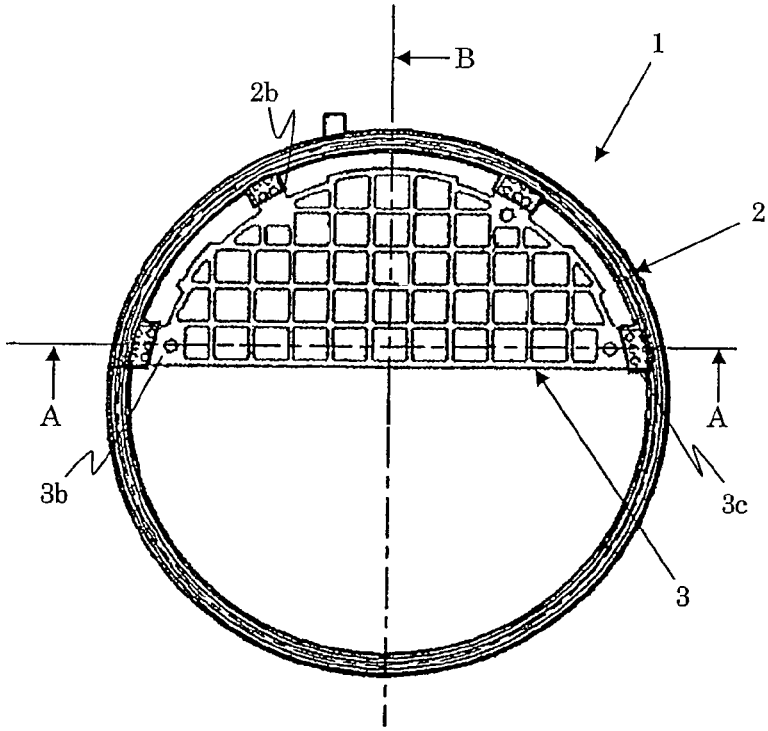
FIG. 2 is a plan view illustrating a connected status of a net member to a gasket.
Figure 3:
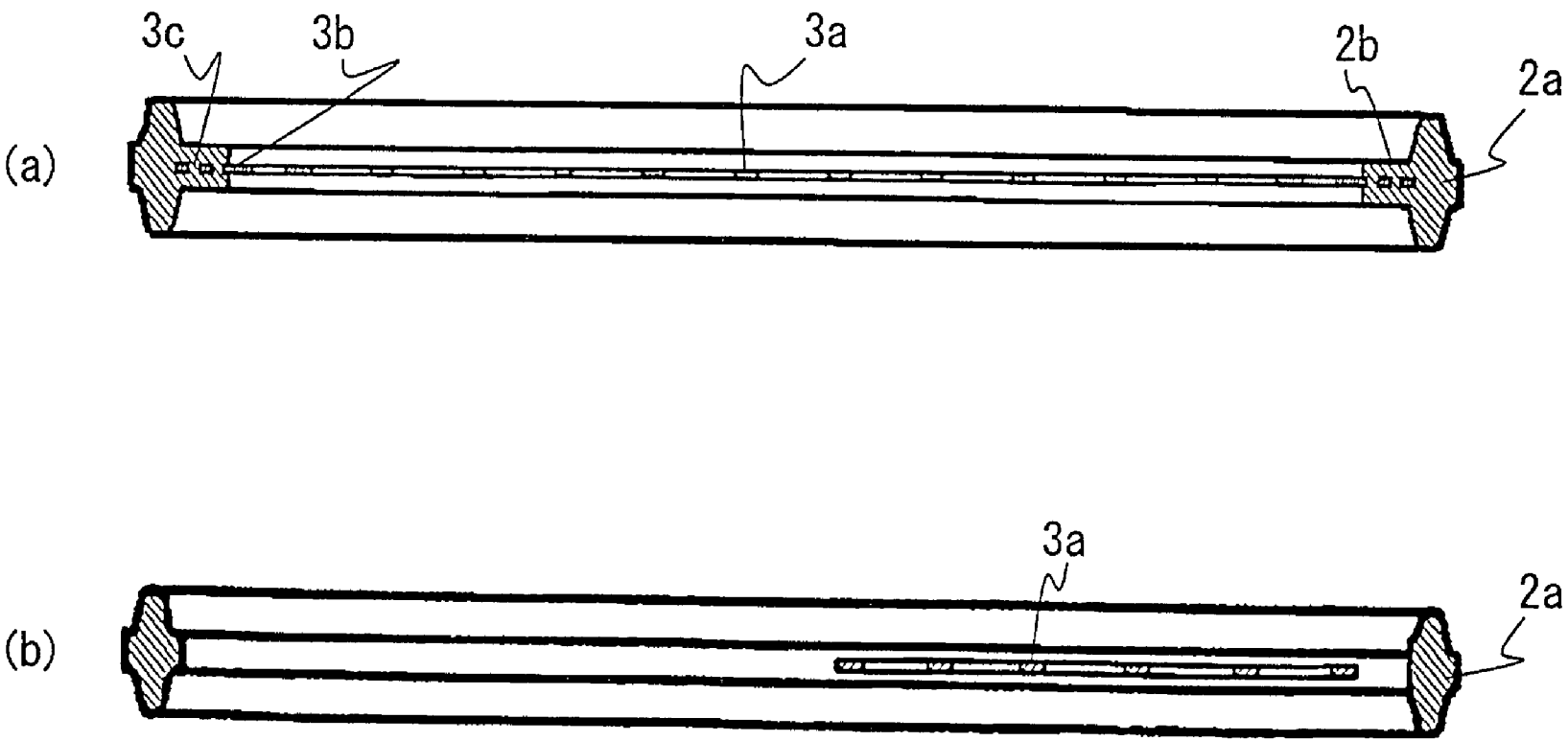
FIG. 3 is cross-sectional views of the connected status illustrated in FIG. 2. (*a*) is a cross-sectional view along A-A line in FIG. 2 and (*b*) is a cross-sectional view along B-B line in FIG. 2.

Hereinafter a connecting structure formed by the gasket 2 and the net member 3 is explained as referring to FIG. 2 and FIG. 3. FIG. 2 is the plan view illustrating the connected status of the net member to the gasket. FIG. 3 (*a*) is the cross-sectional view along A-A line in FIG. 2 and FIG. 3 (*b*) is the cross-sectional view along B-B line in FIG. 2.

Small fitting holes 3*c* functioning as a fitting portion are formed in the connecting protrusion 3*b* of the net member 3. The air intake noise reducing device 1 is manufactured by the following steps: (a) setting net member 3 in a rubber molding die, (b) molding unvulcanized rubber in the rubber molding die and (c) vulcanizing the molded rubber in the rubber molding die. Thus, the gasket 2 and the net member 3 are molded into the one-pieced air intake noise reducing device 1.

The connecting protrusion 3*b* is held in the protrusion holding portion 2*b*, and at the same time unvulcanized rubber flowing in the small holes 3*c* is vulcanized therein, in other words, the protrusion holding portion 2*b* penetrates into the small holes. As a result, the connecting protrusions 3*b* of the net member 3 are buried in the gasket 2, which means the net member 3 is firmly secured to the gasket 2.

The connecting protrusion 3*b* is held within the protrusion holding portion 2*b* such that a tip end of the connecting protrusion 3*b* does not protrude into the ring member 2*a*. Alternatively, the tip end of the connecting protrusion 3*b* may protrude into the ring portion 2*a* to an extent that surface pressure of the ring member 2*a* and the sealing property of the gasket are not affected.

In the air intake noise reducing device 1 by the present embodiment, the net member 3 is uniformly held by the gasket 2. Consequently, the surface pressure can be uniformly imposed on the gasket 2, so that the sealing property in the connecting portion of the air intake passage 100 is not deteriorated. Since the connecting protrusions 3*b* of the net member 3 are buried in the protrusion holding portions 2*b* of the gasket during the vulcanization of the gasket 2, no adhesives are required to fix the net member 3 to the gasket 2, so that any adhering steps are not required when the air intake noise reducing device is manufactured.

In the air intake noise reducing device by the present embodiment, four pairs of the protrusion holding portion 2*b* and the connecting protrusion 3*b* are arranged circularly with a predetermined space apart. The arrangement is not limited to that of the present embodiment, but any arrangement is acceptable as far as the net member 3 is firmly secured to the gasket 2 such that the net member 3 is prevented from coming out of the gasket 2 by the intake air flow. In the same sense, the connecting protrusion 3*b* and protrusion holding portion 2*b* having any size, thickness or the like are acceptable as far as the net member 3 is firmly secured to the gasket 2.

Further the small holes 3*c* having any shape, size and the number are acceptable as far as the net member 3 is prevented from coming out of the gasket 2. It is not always necessary to form the small holes in the connecting protrusion. But the connecting protrusion may be formed in a wedge shape or a combination of the small holes and the wedge shape. The connecting protrusion having a T-formed cross section or a wave formed cross section is an example of the wedge. Since the widest part of the T-formed cross section or the wave formed cross section is molded in and secured to protrusion holding portion 2*b* of the gasket 2, the net is prevented from coming out of the gasket.

In the present embodiment, the gasket 2 is described as a circular one, but it is not limited to this shape. The shape of the gasket should be determined in accordance with a cross-sectional shape of the air intake passage 100.

In the present embodiment, a mesh is employed as the net 3*a*, but it is not limited to the mesh. Any shape may be employed as the net 3*a*, as far as the net is effective in reducing air intake noise. For example, a comb shaped net may be acceptable.

In the present embodiment, the net member 3 occupies ca. 50% of a cross-sectional area of the air intake passage, but it is not limited to this occupied ratio.

Embodiment 2

The present embodiment relates to an internal combustion engine where the air intake noise reducing device 1 by embodiment 1 is arranged in the air intake passage 100. Therefore, only features different from embodiment 1 are explained and the same reference numerals or characters are assigned to the same components.

Figure 4:
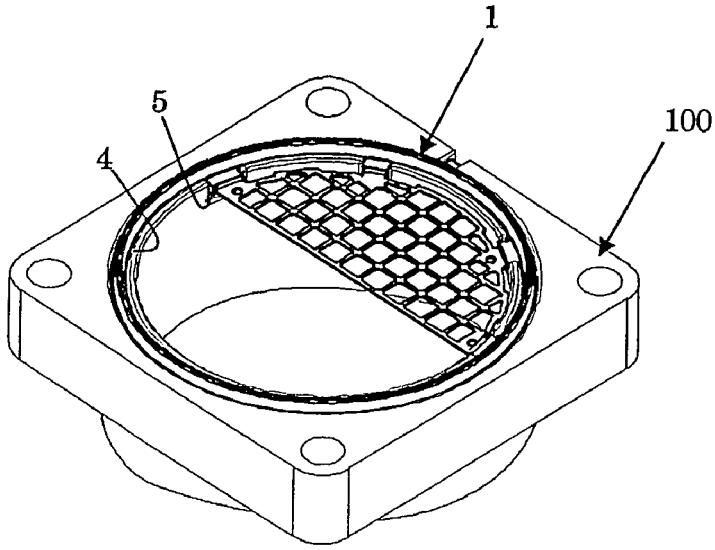
FIG. 4 is a perspective view illustrating the air intake noise reducing device by embodiment 2 attached to a connecting portion of an air intake passage.

FIG. 4 is the perspective view illustrating the air intake noise reducing device by embodiment 2 attached to the connecting portion of the air intake passage.

A seal holding groove 4 for holding the ring member 2*a* of the gasket 2 is formed in the connecting portion of the air intake passage 100. Protrusion holding recesses 5 for holding the protrusion holding portions 2*b* of the gasket 2 are formed inside the seal holding groove 4.

When the air intake noise reducing device 1 is attached to the air intake passage 100 via the connecting portion of the air intake passage 100, the ring member 2*a* of the gasket 2 is held in the seal holding groove 4. And the protrusion holding portions 2*b* of the gasket 2 are held in the protrusion holding recesses 5. Then the gasket 2 is attached to the air intake passage 100 as being held by the end surfaces of the upstream and downstream members of the air intake passage 100.

When the gasket 2 is attached to the air intake passage 100 after the protrusion holding portions 2*b* of the gasket are held in the protrusion holding recesses 5, the protrusion holding portions 2*b* are held by both surfaces of the recesses as well as by the end surfaces of the upstream and down stream members of the air intake passage. Consequently, the gasket 2 is firmly pressed to the net member 3 via its protrusion holding portions 2*b*, so that the net member 3 is prevented from coming out of the gasket 2.

Embodiment 3

In the present embodiment, a concave member for positioning is formed on a surface of the protrusion holding portion 2*b* of the air intake noise reducing device 1 by embodiment 1. Therefore, only features different from embodiments 1 and 2 are explained and the same reference numerals or characters are assigned to the same components.

Figure 5:
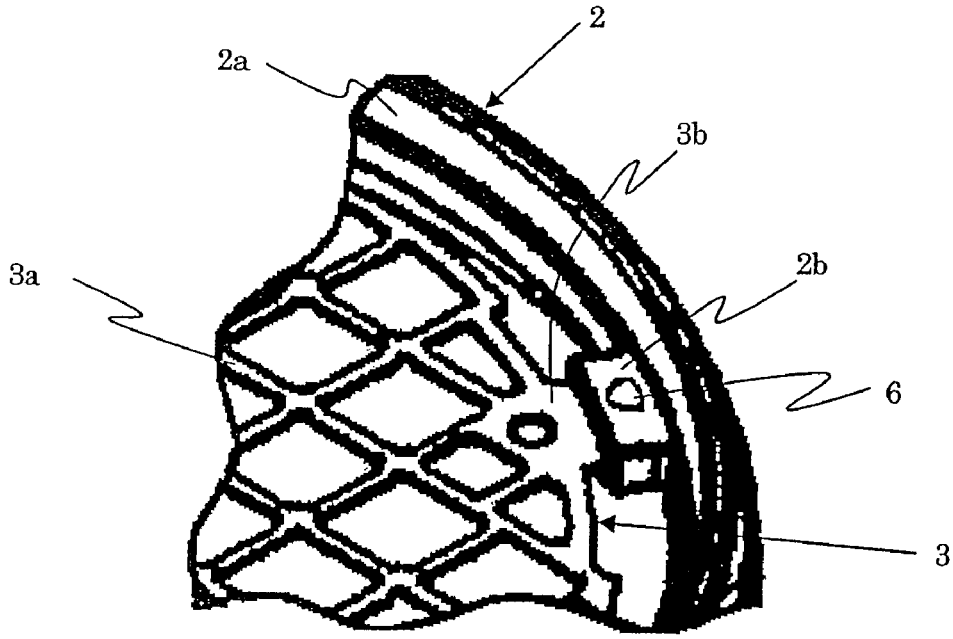
FIG. 5 is a partial perspective view illustrating a characteristic portion of embodiment 3.

FIG. 5 is the partial perspective view illustrating the characteristic portion of the present embodiment.

In FIG. 5, a reference numeral 6 is a concave portion for positioning. The concave portion 6 for positioning is formed on both sides of the protrusion holding portion 2*b*, namely upstream and downstream sides of the air intake noise reducing device.

When the air intake noise reducing device 1 is attached to the air intake passage 100, the protrusion holding portions 2*b* are held in the protrusion holding recesses 5. And the air intake passages 100 are connected on both sides of the air intake noise reducing device, the concave portion 6 is pressed by the protrusion holding recess 5 as well as by the end surfaces of the upstream and downstream members of the air intake passage. By this arrangement, the air intake noise reducing device 1 is firmly positioned, so that vibrations of the air intake noise reducing device caused by intake air are suppressed.

And since the protrusion holding portions 2*b* are firmly held by the surfaces of the protrusion holding recesses as well as held by the end surfaces of the upstream and downstream members of the air intake passage, the gasket 2 is firmly pressed against the net member 3 via its protrusion holding portions 2*b*, so that the net member 3 is surely prevented from coming out of the gasket 2 when the air intake flows.

Further, since the protrusion holding recess 5 may be formed not so precisely, the air intake passage 100 can be easily produced.

Shapes, arrangements, the number and the like of the concave portion 6 are not specifically limited.

The present invention can provide the air intake noise reducing device, the internal combustion engine equipped with such device and the structure for fitting such device with less assembling man-hours without deteriorating the sealing property of the air intake noise reducing device.

And since no adhesives are required for fixing the net member to the gasket, the number of the manufacturing steps is reduced, so that the manufacturing costs are reduced and various materials can be selected for the gasket and the net member without taking adhesives into consideration. Further, since no adhesives are used, the amount of volatile organic materials (VOM) required for manufacturing the device can be reduced, which leads to a safer manufacturing procedure. In addition, since no adhesives are used, the assembled air intake reducing device can be disintegrated more easily than before, so that the disintegrated device can be recycled without difficulties.

Since the net member is not penetrated into inside the gasket, the gasket can be formed smaller. And since reaction in the air intake noise reducing device by the present invention becomes smaller, interference between the gasket and the net member can be set larger. Further, due to the larger interference, a counter component to which the air intake noise reducing device can be roughly designed not so precisely. Since the reaction is small, strength of the counter component can be lowered.

Since the net member is not penetrated into inside the gasket, a thickness of the net member can be determined more freely, so that a rectifying performance of the net member can be enhanced.

What is claimed is:

1. An air intake noise reducing device comprising:

a seal member comprising a ring member held by connecting surfaces of an air intake passage and protrusion holding portions extending from said ring member toward a center of said air intake passage; and an air intake noise reducing member comprising a net for rectifying intake air and connecting protrusions extending outward from said net, wherein:

said connecting protrusions are held in said protruding holding portions such that said air intake noise reducing member is firmly secured to said seal member.

2. The air intake noise reducing device according to claim 1, wherein:

said connecting protrusion is held within said protrusion holding portion such that a tip end of said connecting protrusion does not protrude into said ring member.

3. The air intake noise reducing device according to claim 1, wherein:

said connecting protrusion has a fitting portion for being fitted to said protrusion holding portion.

4. The air intake noise reducing device according to claim 3, wherein:

said fitting portion is formed in a small holed shape and/or in a wedge shape.

5. The air intake noise reducing device according to claim 1, wherein:

said protrusion holding portion has positioning members for positioning the air intake noise reducing device to the air intake passage.

6. An internal combustion engine comprising:

the air intake noise reducing devices according to claim 1; and an air intake passage comprising a seal holding groove for holding said ring member of said air intake noise reducing device and protrusion holding recesses for holding said protrusion holding portions.

7. A fitting structure formed in an air intake passage of an internal combustion engine, wherein:

the air intake noise reducing devices according to claim 1 is arranged downstream and in the vicinity of a throttle valve in said air intake passage;

protrusion holding recesses are formed on connecting surfaces of said air intake passage; and said air intake noise reducing device is fitted to said air intake passage such that protrusion holding portions of said air intake noise reducing device are held by said protrusion holding recesses.

* * * * *